US006767629B2

(12) United States Patent
Shah

(10) Patent No.: US 6,767,629 B2
(45) Date of Patent: Jul. 27, 2004

(54) PRESSURE SENSITIVE TAPE ROLL WITH INTERMEDIATE DIVIDER

(76) Inventor: Kumud Shah, P.O. Box 48870, Nymbu (KE)

( * ) Notice: Subject to any disclaimer, the term of this patent is extended or adjusted under 35 U.S.C. 154(b) by 287 days.

(21) Appl. No.: 10/044,746

(22) Filed: Jan. 11, 2002

(65) Prior Publication Data

US 2003/0131923 A1 Jul. 17, 2003

(51) Int. Cl.[7] ..... C09J 7/02; B32B 7/12

(52) U.S. Cl. ..... 428/343; 428/906; 428/350; 428/352; 428/354; 206/411; 427/207.1

(58) Field of Search ..... 428/343, 906, 428/350, 352, 354; 206/411; 427/207.1

(56) References Cited

U.S. PATENT DOCUMENTS 3,648,835 A * 3/1972 Yucel ..... 206/59 C
5,366,775 A * 11/1994 Kao ..... 428/40
6,224,705 B1 * 5/2001 Kao et al. ..... 156/196

* cited by examiner

*Primary Examiner*—Daniel Zirker
(74) *Attorney, Agent, or Firm*—Sand & Sebolt

(57) ABSTRACT

A transparent tape roll includes a plurality of windings of tape around a central core and further includes an intermediate non-transparent divider placed mid-way between the core and the outermost winding of tape such that the transparent tape is clear to the divider. The divider is placed such that the number or windings between the outermost winding and the divider, and the innermost winding and the divider is such that reflective index of the transparent material as winding layers build up is not substantial enough to effect the clarity of the transparent tape to the divider or core causing clouding.

8 Claims, 5 Drawing Sheets

14
TAPE
140
116
132
118
12
130
16
18

PRESSURE SENSITIVE TAPE ROLL WITH INTERMEDIATE DIVIDER

BACKGROUND OF THE INVENTION

1. Technical Field

This invention relates to rolled transparent adhesive media, and more specifically to rolled transparent tape such as packaging tape and mailing tape. Particularly, the invention is a plurality of windings of transparent pressure-sensitive tape rolled around a core with a non-transparent divider placed midway between the core and the outermost winding of tape such that the transparent tape is clear to the divider.

2. Background Information

Pressure-sensitive media such as transparent tape have been readily available for decades for a variety of different uses. One of the common uses of transparent tape is to seal envelopes, boxes, cartons, or packages to be mailed or otherwise delivered.

Two types of commonly used pressure-sensitive tape for these purposes are mailing tape and packaging tape. In general, there is no difference in the end or final use of mailing tape versus packaging tape. It has however become common practice to refer to smaller rolls of pressure sensitive tape as mailing tape and larger rolls as packaging tape. Typically, the smaller rolls are many layers of rolled transparent pressure-sensitive tape wrapped around a 1½ inch diameter center core, while the larger rolls are many layers of rolled pressure-sensitive transparent tape wrapped around a 3 inch diameter center core.

This common practice has developed because consumers prefer pressure-sensitive tape rolls that are clear to the core and sufficient quantities of mailing tape to satisfy consumer demand may be rolled onto a smaller roll while the quantities of packaging tape expected are greater and must be rolled into a larger roll to maintain clarity. The reason for this preference is the perception that this clear to the core tape is of a higher quality. However, due to optical characteristics of the materials used to manufacture transparent tape, each winding by itself is optically clear; however after a certain number of windings onto a roll, each additional winding on the roll reduces the clarity and eventually clouds the optical path from the outermost winding or layer to the core. This is specifically due to a change in the reflective index as more and more layers are added.

As a result, there is a limit to the number of windings that is acceptable due to a loss of clarity with each winding and the consumer threshold on clarity. The reason for this is that consumers desire to use transparent tape for a variety of reasons such as to seal envelopes, boxes, cartons, or packages to be mailed or otherwise delivered whereby typically the transparent tape is placed over instructions, addresses, or other information on the envelope, box, carton or package which it is desirable to clearly view. A cloudy roll gives the perception that the tape when un-wound into individual layers or strips will be cloudy and thus unacceptable.

In typical industry grade transparent tapes, it has been found and is thus an industry standard that approximately 800 inches of length of a transparent tape wrapped or wound around a 1½ inch core maintains consumer desirable levels of clarity. Where longer lengths of tape are desired to eliminate the need to refill a tape dispenser, it has been found that to maintain approximately the same level of clarity, that a 3 inch core will allow for approximately 2000 inches of length of the same typical industry grade transparent tape to be wrapped or wound therearound. In effect, the same 2000 inches of tape when wrapped on a 3 inch core is clear to its core while cloudy on 1½ inch core; however if the length of tape is reduced to approximately 800 inches the tape becomes clear to the core on a 1½ inch core.

Therefore, the need exists for an improved transparent tape or solution that allows more windings of tape on a given core diameter to satisfy the consumer need for more tape per roll while also providing at least the appearance of a clear roll of tape to a core or surface on which graphics, text, directions, instructions, advertisements, trademarks, warranties, limitations, or other information is provided.

BRIEF SUMMARY OF THE INVENTION

The invention is a pressure-sensitive transparent tape, for packaging or mailing, that includes a flexible transparent member and a flexible non-transparent divider. The flexible transparent member has a length greater than its width and is adapted to be wound on a core so as to define a plurality of windings including an innermost winding around the core, an outermost winding and at least one intermediate winding therebetween. The flexible non-transparent divider is positioned in between the innermost and outermost windings.

The invention is also a method of manufacturing this tape where the method includes unwinding a first section from a flexible transparent material of a first width and first length from a master roll where the flexible transparent material includes a top surface and a bottom surface, and at least a portion of the bottom surface of the flexible transparent material having an adhesive applied thereto, winding the flexible transparent material from the master roll onto an elongated core to define an intermediate roll having a plurality of windings including an innermost winding adjacent the elongated core and a plurality of additional windings, and inserting a non-transparent divider at a desired position along the first section after unwinding of the first section from the master roll and prior to the winding of the flexible transparent material onto the elongated core defining the intermediate roll.

BRIEF DESCRIPTION OF THE SEVERAL VIEWS OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DETAILED DESCRIPTION OF THE INVENTION

Figure 1:
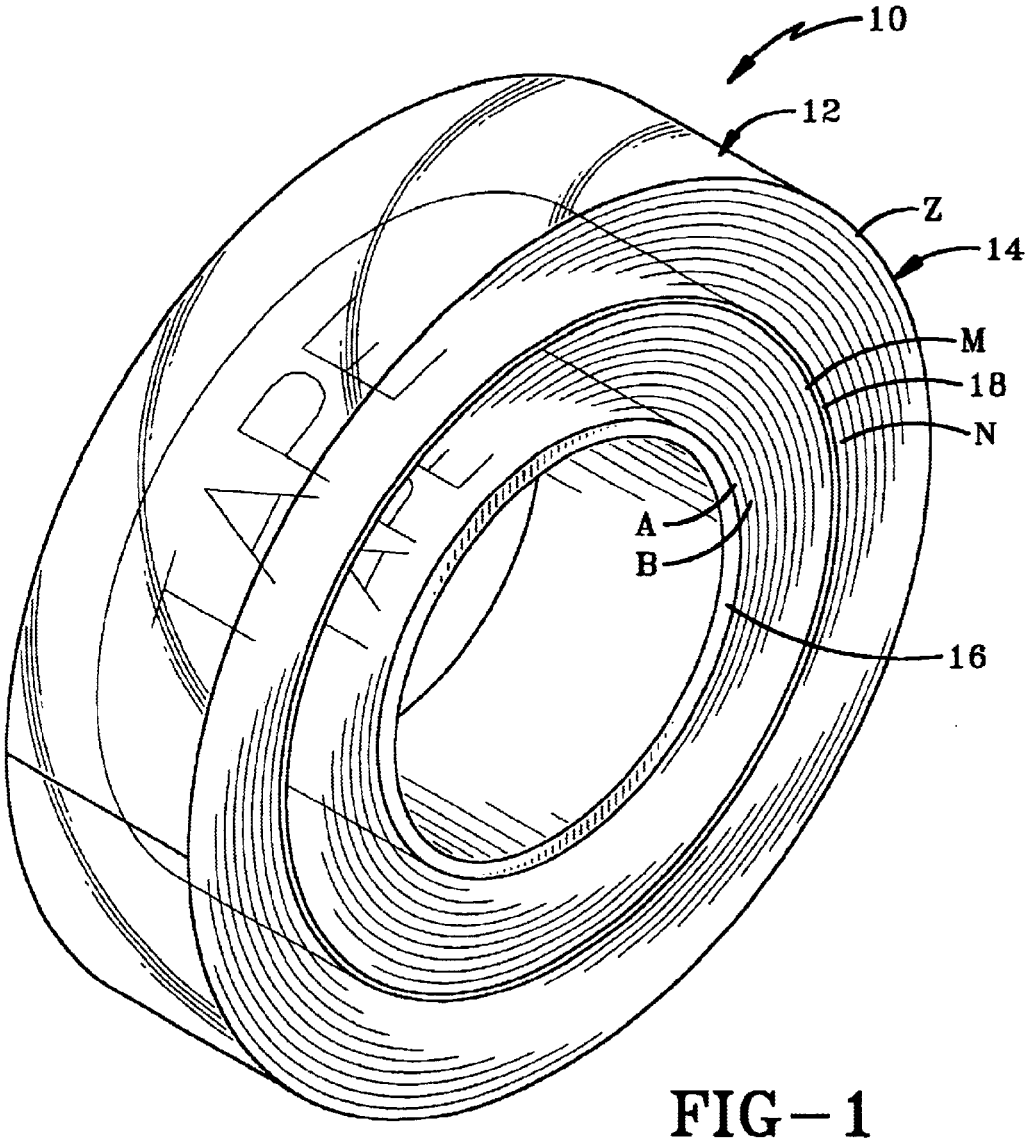
FIG. 1 is a perspective view of the transparent tape roll of the present invention including a plurality of windings of transparent tape about an inner core, and a non-transparent divider or insert wound midway between the inner core and the outermost winding of transparent tape.

Referring now to the drawings, the overall arrangement of the preferred embodiment of the present invention 10 is shown in FIG. 1 as an elongated flexible member 12 wound into a roll 14 about a core 16 with a divider or insert 18 therein. More specifically, a plurality of windings (A being the innermost, B the next innermost, and so on to Z the outermost) of the flexible member 12 are rolled around the core 16 with the non-transparent divider 18 placed mid-way between the core 16 and the outermost winding Z of the flexible member 12. The flexible member 12 having a length greater than its width and being adapted to be wound on the core 16.

As shown best in FIGS. 4–7, in one embodiment the flexible member 12 is a transparent adhesive media such as a transparent tape and has a top surface 20 and a bottom surface 22 which define a tape body 24 therebetween. At least a portion and typically all of the bottom surface 22 of the flexible member 12 has an adhesive applied thereto. The adhesive can be pressure-sensitive adhesive, so that when the tape is applied to an object, it is secured readily thereto by the sensitive character of the adhesive. The adhesive can also be of the remoistening type, and can consist of an adhesive applied to the bottom surface 22 which is allowed to dry, the adhesive being re-moistened before application to the object to be packaged. It will be understood by those skilled in the art that the present invention can be utilized with any type of adhesive tape. The tape body 24 can be formed of plastic, paper, or any frangible or rupturable material that is usable as tape or other similar flexible and elongated material.

In more detail, core 16 is any standard core that tape or other like flexible members are wrapped around. Core 16 is typically a right circular cylindrical winding surface having flexible member or tape 12 wound therearound where the cylindrical winding surface defines an axis about which the winding occurs. More specifically, core 16 is often a hollow cylindrical tube that may be made of cardboard, plastic, metal, wooden, or other material.

The bottom surface 22 (having the adhesive applied thereto) of a first end 30 of the tape body 24 is adhered to the cylindrical winding surface of core 14 and wound therearound such that innermost winding A is defined. Additional windings B and so on are defined as the winding continuing therefrom where winding B overlaps winding A, winding C overlaps winding B and so on. A plurality of windings are defined to an outermost winding Z.

In accordance with one of the features of the invention, non-transparent divider 18 is inserted into the windings at some mid-way point between innermost winding A and outermost winding Z. The term mid-way in the sense defined by this invention means intermediate or anywhere between windings A and Z, and as such could be between windings A and B at one extreme, windings Y and Z at another extreme, or anywhere in between windings A and Z including a true midpoint of between windings M and N or in any other desirable location. The use of the letters to define the layers is meant to define any number of layers and not necessarily twenty-six (26) layers because of alphabetic limitations.

In one embodiment, a typical roll of packaging tape of approximately 2000 inches of length is wrapped around core 16. Divider 18 is placed in between a pair of adjacent intermediate windings due to the change in the reflective index of the transparent material as layers build up due to winding, after a certain number of windings the clarity of the roll from the outermost layer to the core becomes cloudy. Specifically, the divider 18 is placed between 800 inches and almost 2000 inches from the core 16. This in effect reduces the number of windings from the outermost winding Z to a non-transparent surface which is the inserted divider 18 to a number insufficient to significantly change the reflective index enough to cloud the transparent tape. The result is a clear look to the tape, and legible viewing of the divider 18 such as of graphics and text on the divider 18.

Figure 2:
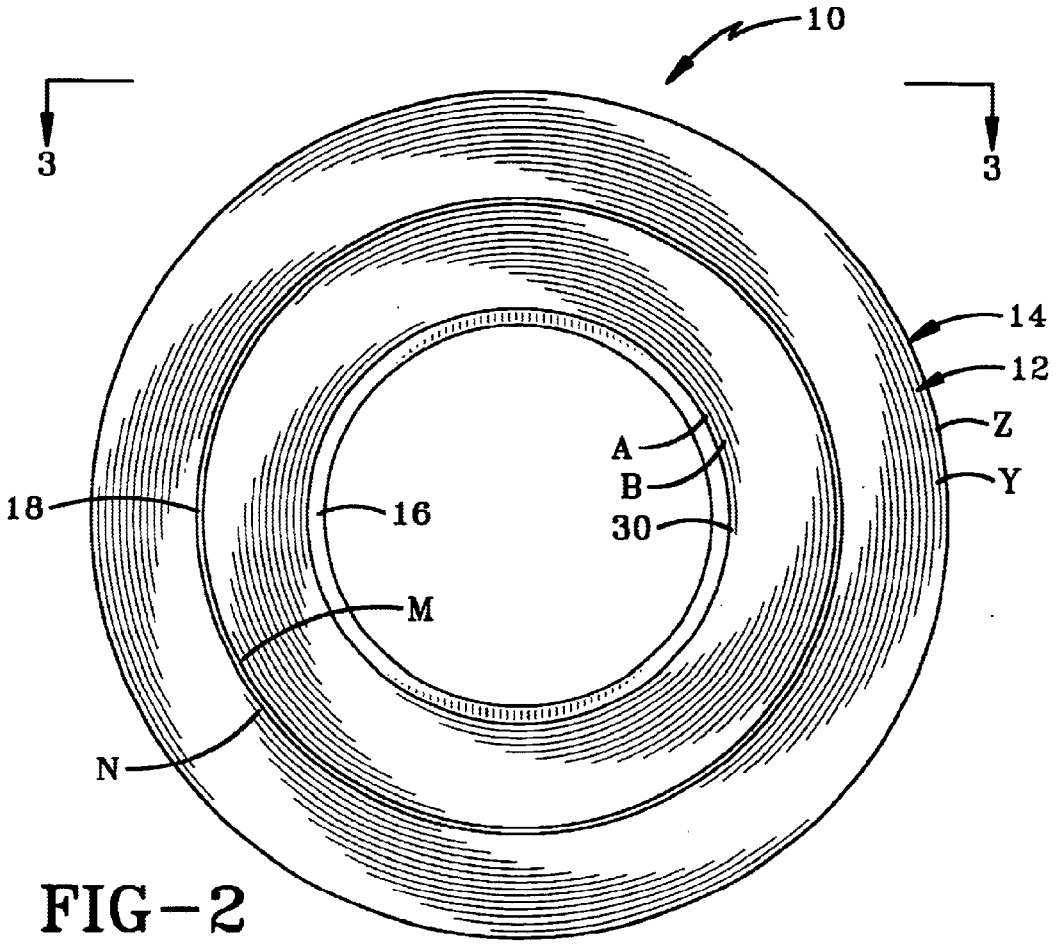
FIG. 2 is an axial side view of the present invention of FIG. 1.
Figure 3:
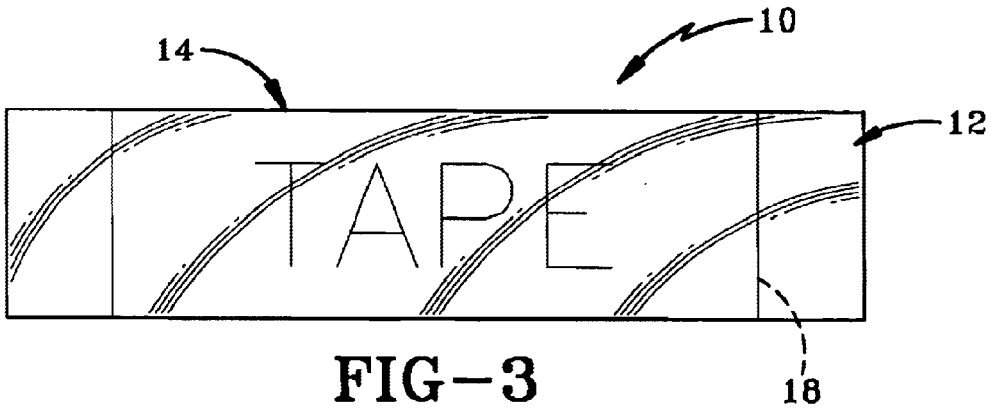
FIG. 3 is an end view of the present invention of FIGS. 1 and 2 taken along lines 3—3 in FIG. 2.
Figure 4:
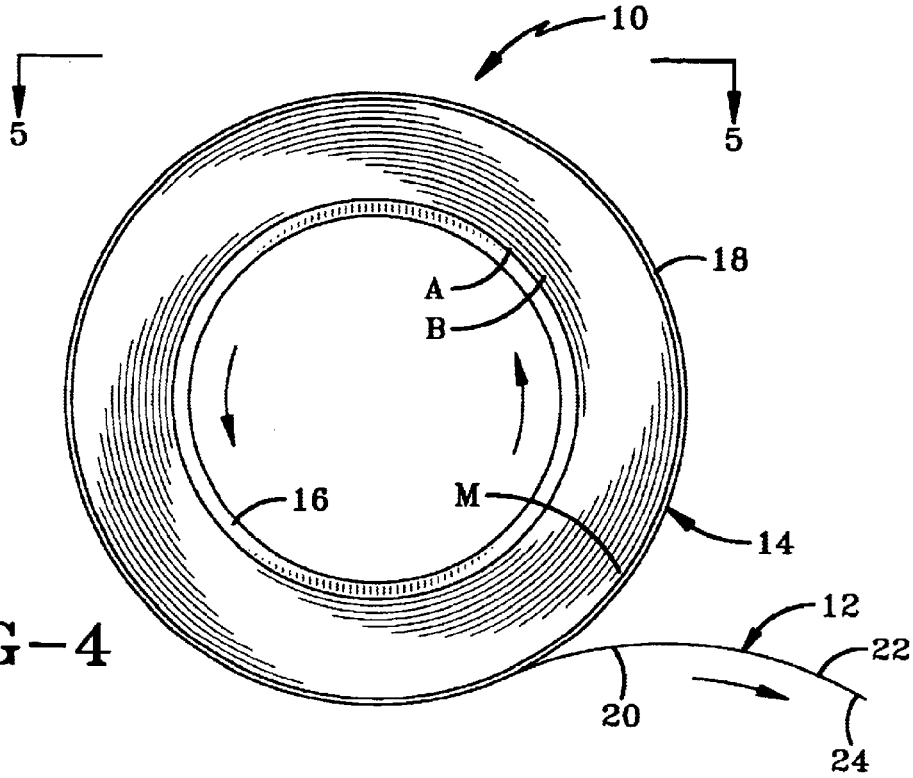
FIG. 4 is the same axial side view as FIG. 2 except that a portion of plurality of windings of transparent tape have been removed to the extent that the non-transparent divider is or is nearing being the outermost layer.
Figure 5:
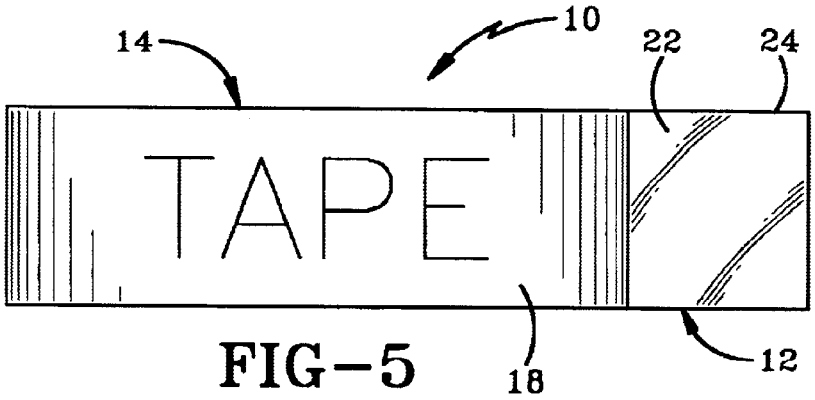
FIG. 5 is an end view of the present invention of FIG. 4 taken along lines 5—5 in FIG. 4.
Figure 6:
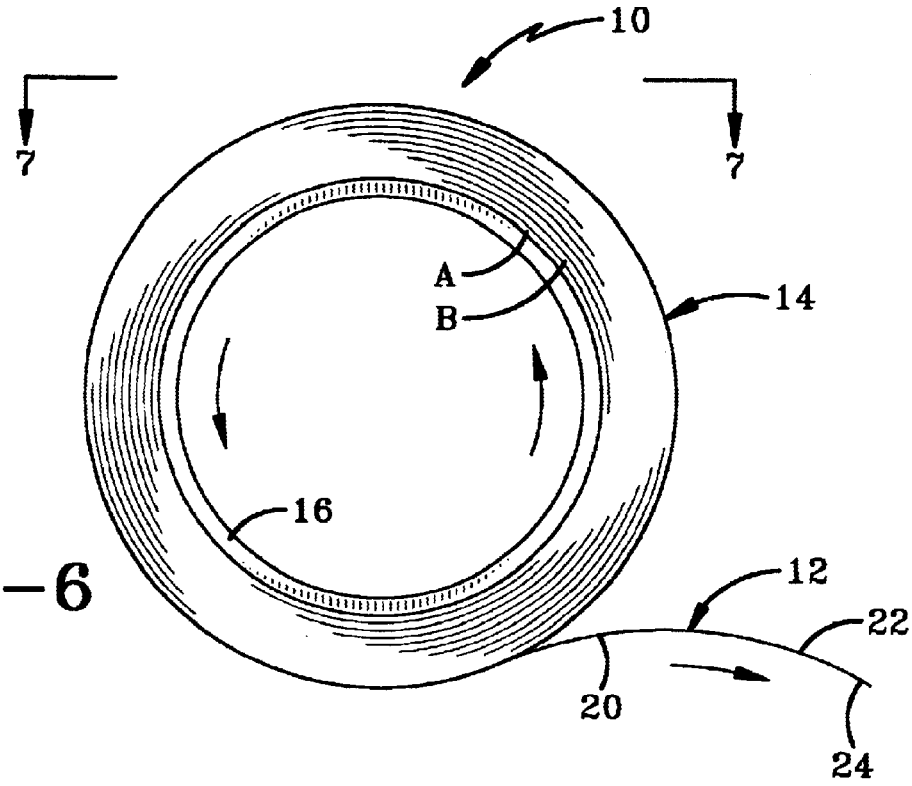
FIG. 6 is the same axial side view as FIG. 4 except that a larger portion of plurality of windings of transparent tape have been removed to the extent that the non-transparent divider has been removed.
Figure 7:
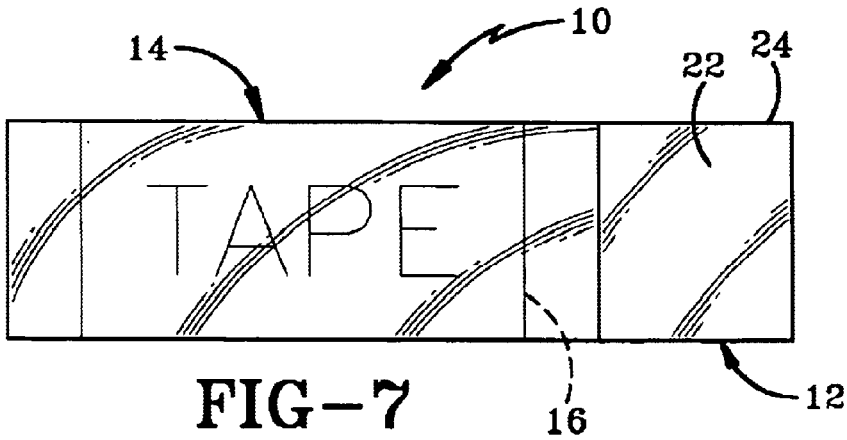
FIG. 7 is an end view of the present invention of FIG. 6 taken along lines 7—7 in FIG. 6.

As the tape is used from an initial full roll as shown in FIG. 2, the windings are reduced. Eventually, the windings are unwrapped and adhered elsewhere, and thus reduced to the extent that the divider 18 is reached as shown in FIG. 4. It may be disposed of at that point, whereby the remaining windings are now visible to the core 16 and may be selectively unwrapped as shown in FIG. 6. The remaining windings are of a number insufficient to significantly change the reflective index enough to cloud the transparent tape. The result is a clear look to the remaining tape, and legible viewing of the core 16 such as of graphics and text on the core 16.

It is contemplated that multiple dividers 18 could be placed between windings A and Z should it be desirable to provide a tape roll of even larger size where more than one divider is needed to maintain clarity throughout the tape roll.

Divider or insert 18 may be made of any material that is non-transparent. In one embodiment, divider 18 is of the same width as tape 12. It is also preferred that divider 18 is of a length equal to or greater than the length of the adjacent windings so as to provide a non-transparent base surface to be viewed through the transparent winding above the insert.

Figures 8, 9:
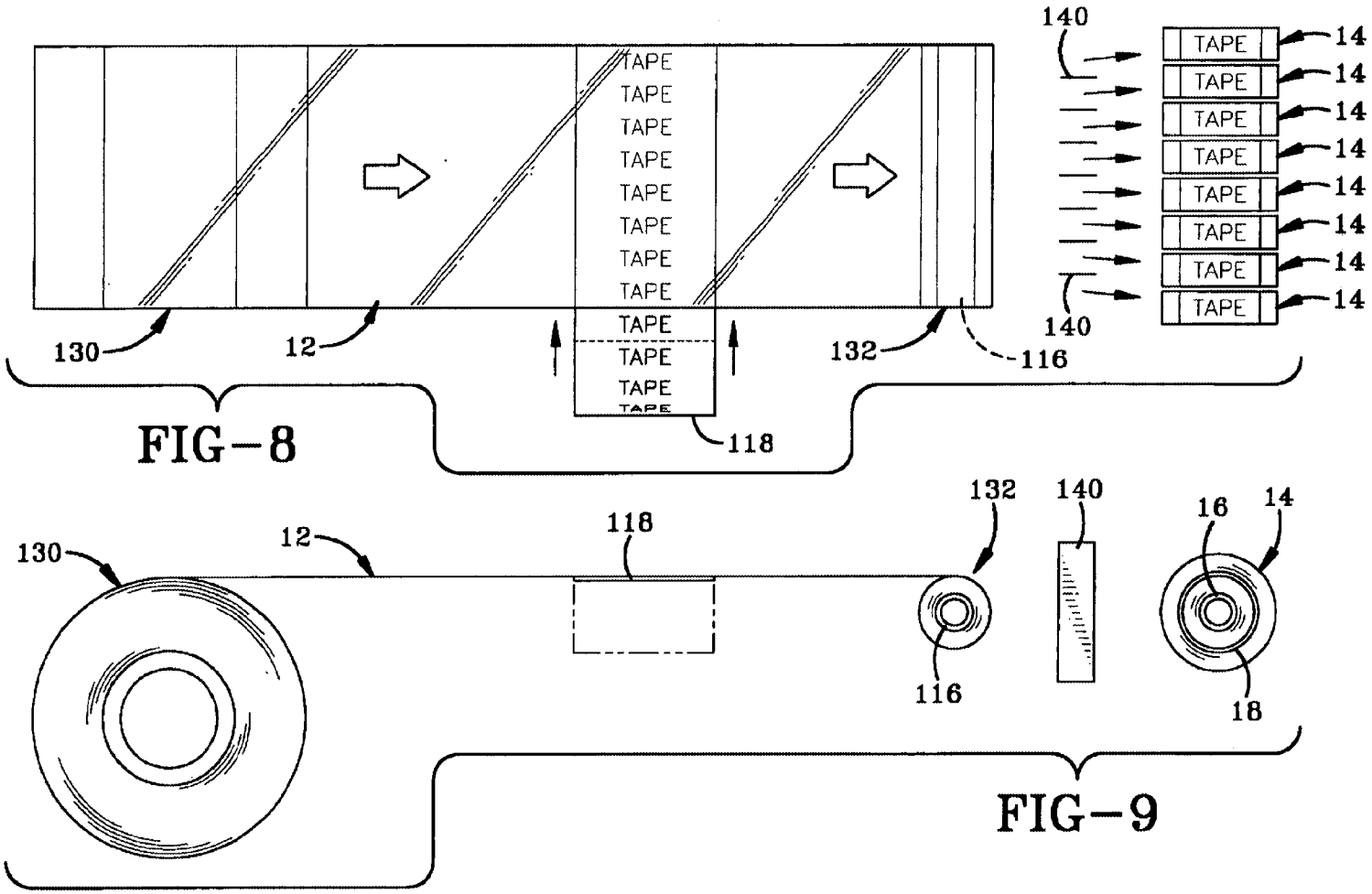
FIG. 8 is a top view of one of the manufacturing processes used to manufacture the present invention of FIGS. 1–7.
FIG. 9 is a side view of the manufacturing process of FIG. 8.

In more detail as to manufacturing of a tape roll with the divider 18 therein, one embodiment is as follows. Desired overall tape lengths (such as 800 inches or 2000 inches) are wound onto an elongated core 116 from a master roll 130 of flexible material as is shown in FIGS. 8–9 where this master roll is both of large length to provide for many rolls and of much larger width since it will be later severed into rolls as is well known in the art. At the desired position from the core 116, which in one embodiment above was noted as between 800 inches and almost 2000 inches from the core on a desired 2000 inch long tape roll, a plurality of still connected dividers 118 are provided and adhered to the tape after it is removed from the master roll but prior to winding the tape around elongated core 116. Once a sufficient length, such as 800 inches to 2000 inches is wound around core 116, a lift tab is provided as is well know in the art and the flexible master material is severed thus defining an intermediate roll 132, often referred to in the tape business as a leg roll, which is of the desired end length but still of the width of the master roll 130 rather than an individual tape roll 14. In one embodiment, this master roll and intermediate roll width is 50 or 60 inches.

The leg roll 132 must then be processed into individual tape rolls 14. This is accomplished by slitting such as on a slitting machine which includes one or more knives 140.

These knives are at a distance necessary to provide individual tape rolls 14 of the desired width. The leg roll 132 is rotated into the knives causing the knives to cut the leg roll into individual tape rolls 14 each having the plurality of windings of tape around a core 16 with a divider 18 therein.

It is contemplated that the divider 118 could also be inserted onto the master roll 130 during its manufacture. Specifically either when adhesive is deposited onto the flexible material, or when the flexible material with adhesive thereon is rolled.

It is further contemplated that an additional step could be added whereby a master roll 130 is unwound to add a divider 118 and then rewound into a master roll with a divider therein. The master roll with the divider therein may then later be processed into a leg roll 132 and eventually individual tape rolls 14.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

I claim:

1. A packaging tape, comprising:

a flexible transparent member having a length greater than its width so as to define a plurality of windings including an innermost winding, an outermost winding and at least one intermediate winding therebetween; and a flexible non-transparent divider positioned in between the innermost and outermost windings.

2. The packaging tape of claim 1 wherein the flexible transparent member includes a top surface and a bottom surface which define a tape body therebetween, at least a portion of the bottom surface of the flexible member having an adhesive applied thereto.

3. The packaging tape of claim 2 wherein the divider is approximately the length of one winding.

4. The packaging tape of claim 2 wherein the divider is positioned approximately mid-way in between the innermost and outermost windings.

5. The packaging tape of claim 2 wherein the at least one intermediate winding comprises a plurality of intermediate windings and the divider is positioned in between a pair of the plurality of intermediate windings such that the flexible transparent member remains at least substantially clear from the outermost winding to the divider and from the divider to the innermost winding.

6. The packaging tape of claim 5 wherein the flexible transparent member has a length of at least 800 inches.

7. The packaging tape of claim 5 wherein the flexible transparent member has a length of approximately 2,000 inches.

8. The packaging tape of claim 2 wherein the at least one intermediate winding comprises a plurality of intermediate windings and the divider is positioned in between a pair of the plurality of intermediate windings such that the flexible transparent member remains clear from the outermost winding to the divider and from the divider to the innermost winding.

* * * * *